US005859588A

United States Patent [19]

Malone et al.

[11] Patent Number: 5,859,588

[45] Date of Patent: Jan. 12, 1999

[54] PURSE EQUIPPED TO DISPERSE PEPPER SPRAY AND AIR SIREN

[76] Inventors: Patrick W. Malone, 724 E. Main St. (Rear); Jeffrey M. Smith, 606 W. Adams St. Apt #4, both of Jackson, Mo. 63755

[21] Appl. No.: 896,868

[22] Filed: Jul. 18, 1997

[51] Int. Cl.[6] ..... G08B 13/00

[52] U.S. Cl. ..... 340/574; 116/DIG. 44; 340/693

[58] Field of Search ..... 340/574, 328, 340/384.1, 321, 693; 222/175, 192, 153.11, 153.13, 613; 116/DIG. 44

[56] References Cited

U.S. PATENT DOCUMENTS

| | | | |
|---|---|---|---|
| 4,067,290 | 1/1978 | Hartley | 116/DIG. 44 |
| 4,617,558 | 10/1986 | Gin | 340/571 |
| 4,885,570 | 12/1989 | Chien | 340/574 |
| 5,289,164 | 2/1994 | Novak | 340/574 |
| 5,629,679 | 5/1997 | Cranford et al. | 340/574 |
| 5,635,908 | 6/1997 | Soper | 340/574 |

FOREIGN PATENT DOCUMENTS

| | | | |
|---|---|---|---|
| 2019625 | 10/1979 | United Kingdom | 340/574 |

*Primary Examiner*—Brent A. Swarthout

[57] ABSTRACT

A personal safety device including a handbag with pepper spray and air siren cannisters stored therein, a button on the handle of the handbag activating a switch to actuate the cannisters, the pepper spray being dispersed through a hole in the handle, the air siren being directed through a vent in the handbag, and including a safety lock in the handle to prevent accidental dispersion of the cannisters.

1 Claim, 1 Drawing Sheet

PURSE EQUIPPED TO DISPERSE PEPPER SPRAY AND AIR SIREN

BACKGROUND-FIELD OF INVENTION

Figure 1:
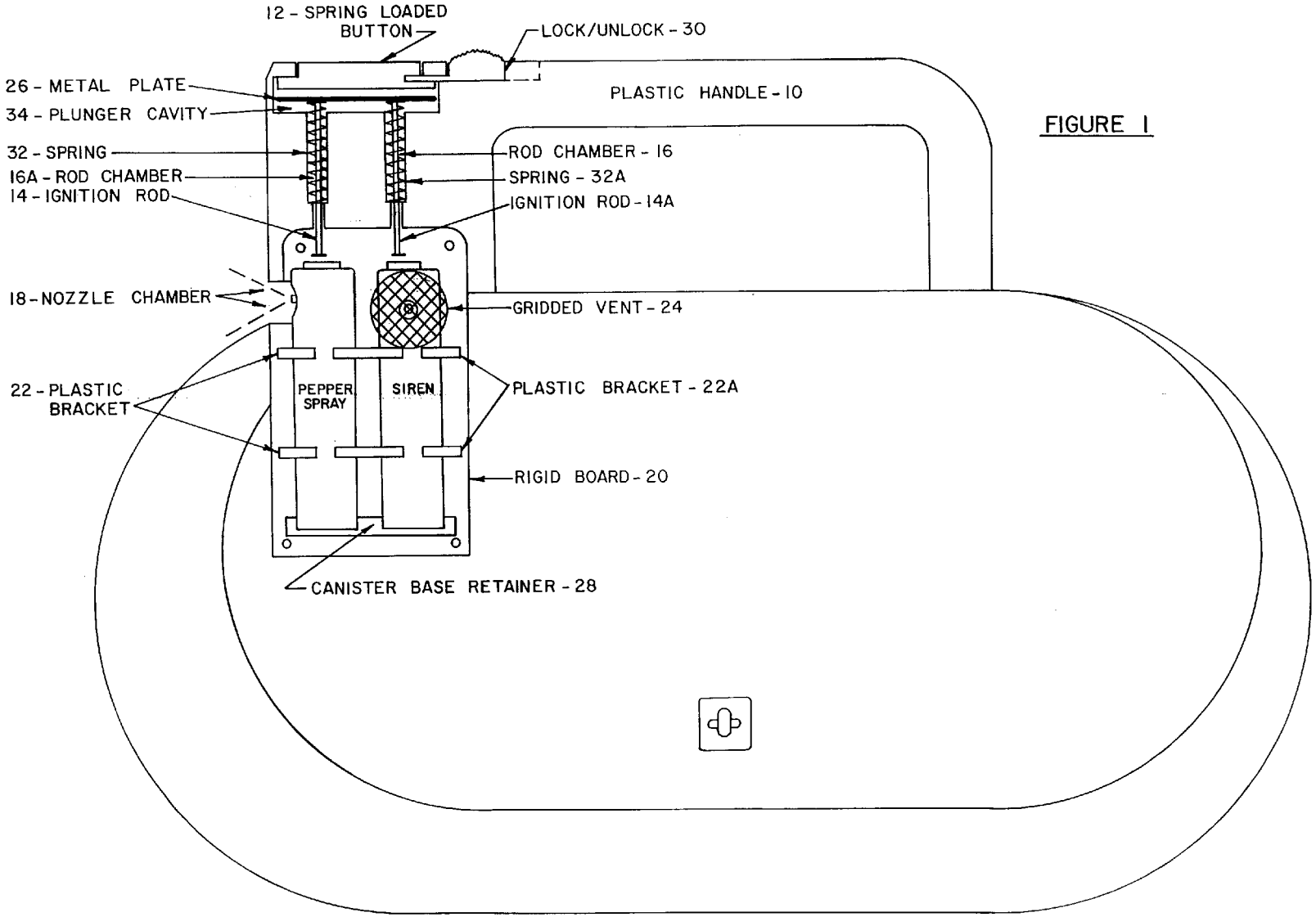

This invention relates to a handbag that is equipped to disperse both pepper spray and air siren.

BACKGROUND

This invention relates to a Women's' purse that is equipped to disperse pepper spray and air siren. These devices are built into the purse and are easily activated by depressing a button located in the handle of the purse. The purse itself has the appearance of an ordinary purse in that it is of the same design and material of other fashionable purses. The purse has an effective range of six to eight feet. At this distance, an attacker would be unable to distinguish this purse from an ordinary one.

Many women purchase various personal protection devices, such as mace spray, pepper spray, air sirens, etc. Unfortunately, when the critical moment arrives when they are being attacked these devices are not readily available. They are being stored inside a pocket, briefcase, etc. Statistics reveal that most victims are taken completely by surprise with no time to react.

Our purse equipped to disperse pepper spray and air siren is instantly available for immediate use in the event of an attack. Both the pepper spray and the air siren are activated simultaneously by depressing one button located in the purse handle. Conventional personal safety devices such as mace and pepper spray, when yielded against an attacker, afford the attacker with a few seconds to prepare a "counter attack". By using our purse equipped to disperse pepper spray and air siren, the attacker is afforded no such preparation. The attacker is completely surprised, and the victim has those precious seconds needed to escape or to summon help.

OBJECTS AND ADVANTAGES

Accordingly, besides the objects and advantages of the purse equipped to disperse pepper spray and air siren described in my above patent, several objects and advantages of the present invention are:

(a) To provide a personal protection device in the form of a purse that will disperse both pepper spray and air siren in a manner that is easy to operate (b) To provide a pepper spray and air siren dispersing device that has the appearance of an ordinary purse, providing the user with an element of surprise against attackers.

(c) To provide a means to easily load and unload pepper spray and air siren canisters inside the purse, using a mounted bracket with plastic brackets.

(d) To provide an easy to operate button, located on the purse handle, which activates both the pepper spray and air siren simultaneously.

(e) To provide a lock/unlock mechanism located on the purse handle, used as a means of locking the button to prevent its accidental depression.

Description- FIG. 1

FIG. 1 shows a perspective view of a basic version of our purse equipped to disperse pepper spray and air siren. On the top of a handle 10 is a small plastic spring loaded button 12. When the button is depressed, a metal plate 26 to which two ignition rods 14, 14A are attached by means of welding, is pushed down. The end of the ignition rods, 14, 14A are pushed down and simultaneously depress a can of pepper spray and air siren. The canister of pepper spray and air siren are not part of the invention. It is intended that these items be added to the purse for use. A metal lock/unlock button 30, located in the handle 10 beside the spring loaded button 12, fits in a grove in the handle 10. By sliding the lock/unlock button 30 towards the spring loaded button 12, a metal pin fits securely into a hole in the spring loaded button 12. This lock/unlock button 30 serves as a safety feature to ensure that the spring loaded button 12 is not accidentally depressed. The handle 10 has two chambers 16, 16A along a vertical axis which allows two metal ignition rods 14, 14A to pass. Each of the two ignition rods 14, 14A pass through a spring 32, 32A. These springs 32, 32A push the metal plate 26 upward into the button 12. A chamber 18 is located at the base of the handle 10 distal end. This chamber 18 opening allows a pepper spray stream to pass. The chamber 18 opening is large enough that it does not impede or interfere with the pepper spray stream. On the interior of the purse a thin rigid board 20 is attached by means of rivets to the purse. Attached to the rigid board 20 are two plastic brackets 22, 22A by means of rivets. These plastic brackets 22, 22A serve to securely hold a canister of pepper spray and a canister of air siren. Plastic brackets 22, 22A are designed to allow placement of pepper spray and air siren canisters by applying pressure to the sides of the canisters until they snap securely into place in the plastic brackets 22, 22A. At the bottom of the plastic brackets 22, 22A is a canister base retainer 28. This canister base retainer 28 serves as a ledge onto which the bottom of the pepper spray and air siren canisters rest. The width of the canister base retainer 28 is wide enough for both the pepper spray and air siren canisters. The depth of the canister base retainer 28 is the same as both the pepper spray and air siren canisters. The canister base retainer 28 prevents the canisters of pepper spray and air siren from moving downward while the ignition rods 14, 14A are pushed down, On the outer flap of the purse is a small plastic gridded vent 24. A small disc shaped section of the purses'outer flap is cut out and is replaced with the small plastic gridded vent 24. This gridded vent 24 serves as an outlet for the piercing sound emitted by the air siren. Without this gridded vent 24 the air sirens sound would be muffled inside the purse.

Operation- FIG. 1

Operation of our purse equipped to disperse pepper spray and air siren first begins by placement of pepper spray and air siren canisters into the purse. The outer flap of the purse is opened to reveal the canister base retainer 28 onto which are mounted plastic brackets 22, 22A. Pepper spray and air siren canisters are snapped securely into place in the plastic brackets 22, 22A by applying pressure to the side of the canisters. The outer purse flap is then closed and secured. The purse is carried in the normal fashion as other purses. In the event of an attack, the user of the purse depresses a button 12 located in the handle 10 of the purse. The handle is pointed in the direction of the attacker, and the attacker receives a stream of pepper spray. When the button 12 is depressed, both pepper spray and air siren are simultaneously activated. The sound of the air siren is released through a gridded vent 24 located on the side of the purse. When the purse is not in use, a metal lock/unlock button 30 can be slid into place to lock the button 12 into place.

SUMMARY, RAMIFICATIONS, AND SCOPE

Accordingly, the reader will see that the purse equipped to disperse pepper spray and air siren can be used easily, safely and conveniently, while affording the user with an economical yet highly effective means of self protection in the event of an attack. Furthermore, the purse equipped to disperse pepper spray and air siren has the additional advantages in that

- it allows the user immediate access to the pepper spray and air siren. Most individuals who presently use these devices for self defense carry them inside a pocket where they are not readily available.
- it provides for a method of using multiple personal safety devices simultaneously, by depressing a single button that is located on the handle of the purse.
- It is designed to be part of a women's purse, an item which is typically carried by most women practically everywhere they go.

Although the description above contains many specifications, these should not be construed as limiting the scope of the invention but as merely providing illustrations of some of the presently preferred embodiments of the invention.

I claim:

1. A device which disperses pepper spray and activates an air siren comprising:

a handbag having mounted brackets inside to store a pepper spray cannister and an air siren cannister;

a means to activate said pepper spray cannister and said air siren cannister by depressing a button located in a handle of the handbag, which causes downward movement of at least one switch contact rod through the handle;

said handle of the handbag having a hole through which pepper spray is dispersed;

the handbag having a vent adjacent the air siren through which the sound of the air siren is released;

and a safety locking device located in said handle of the handbag which serves as a means to prevent accidental depression of the pepper spray and air siren activation button.

* * * * *